United States Patent [19]

Plotkowiak et al.

[11] 4,431,377

[45] Feb. 14, 1984

[54] COMPRESSOR WITH PUMP RECYCLING FOR ISOTOPIC SEPARATION THROUGH GASEOUS SCATTERING

[75] Inventors: Joseph Plotkowiak, Carrieres sur Seine; Herve A. Quillevere, Issy les Moulineaux, both of France

[73] Assignees: Hispano-Suiza, Saint Cloud; Societe Nationale d'Etude et de Construction Moteurs d'Aviation SNECMA, Paris, both of France

[21] Appl. No.: 240,936

[22] Filed: Mar. 5, 1981

[30] Foreign Application Priority Data

Mar. 6, 1980 [FR] France ..... 80 04998

[51] Int. Cl.[3] ..... F04B 39/10

[52] U.S. Cl. ..... 417/89; 417/78

[58] Field of Search ..... 417/78, 87, 89

[56] References Cited

U.S. PATENT DOCUMENTS

| | | | |
|---|---|---|---|
| 1,115,942 | 11/1914 | Kieser | 417/78 |
| 4,117,671 | 10/1978 | Neal et al. | 60/262 |

FOREIGN PATENT DOCUMENTS

| | | | |
|---|---|---|---|
| 280420 | 1/1914 | Fed. Rep. of Germany | 417/78 |
| 396547 | 11/1908 | France | 417/78 |
| 923774 | 7/1947 | France . | |
| 1237157 | 6/1960 | France . | |
| 2010938 | 2/1970 | France . | |
| 2278958 | 2/1976 | France . | |
| 2338400 | 8/1977 | France . | |
| 2359629 | 2/1978 | France . | |
| 55-87887 | 7/1980 | Japan | 417/89 |

*Primary Examiner*—Alan Cohan
*Assistant Examiner*—John A. Rivell
*Attorney, Agent, or Firm*—Oblon, Fisher, Spivak, McClelland & Maier

[57] ABSTRACT

A compressor which compresses a principal flow at low pressure and recompresses a secondary flow at medium pressure to deliver a common flow at high pressure. The compressor includes, in addition to compression devices for the principal flow, static devices forming an induction nozzle housed in the scatterer and devices to introduce therein the secondary flow, the principal flow constituting the drive flow.

4 Claims, 4 Drawing Figures

COMPRESSOR WITH PUMP RECYCLING FOR ISOTOPIC SEPARATION THROUGH GASEOUS SCATTERING

BACKGROUND OF THE INVENTION

1. Field of the Invention

The present invention concerns a compressor with recycling of a secondary flow.

More precisely, the present invention involves a compressor which makes it possible to deliver in its scattering portion an outlet flow at a given pressure from a principal flow having a first pressure and a secondary flow at a second pressure, the second pressure being greater than the first pressure, the outlet pressure being greater than the first and second pressures.

Still more precisely, the present invention involves a compressor of this type for installations for the enrichment of uranium by the gaseous scattering process. It is known that in such installations the enrichment of the gaseous mixture containing the isotopic mixture of uranium 235 and uranium 238 is done through a series of scatterers in which uranium hexafluoride circulates. In each scattering stage, i.e., in each scatterer, it is necessary both to inject the gaseous flow leaving the preceding stage and to recycle the secondary gaseous flow coming from the following stage.

The problem to be solved will be better understood by referring to the attached FIG. 1. In this FIGURE the stages N−1, N and N+1 of isotopic enrichment by gaseous scattering have been shown. The gas containing the isotopic mixture is introduced into a set of porous scattering or scatterer gates, and a fraction of this gaseous flow passes through the porous wall to be enriched in the lighter isotope, i.e., the uranium 235. This flow which has passed through the porous wall in the scatterer in row N is recycled at the inlet of the N+1 scatterer. The flow which has not scattered in the N scatterer is recycled in an upstream scatterer, the rank of which depends on the rate of enrichment. For example, in a simplified cycle, it may be considered that the principal gaseous flow which has scattered in the row N scatterer is recycled through the intermediary of a compressor in the row N+1 scatterer. In contrast, the gaseous flow which has not scattered is recycled in the row N−1 scatterer. It is therefore understood that, generally speaking, it is necessary at the inlet of each scatterer to introduce a gaseous flow mixture resulting on the one hand from the unscattered principal flow coming from the scatterer in the preceding row and on the other from the gaseous flow which has scattered and which comes from the scatterer in the lower row. In addition, these two flows, because of their passage or their nonpassage through the scattering wall, have different pressures. It is of course necessary to compress the principal flow and the derived flow to provide it with a common pressure at the outlet of the compressor compatible with the optimum operation of the installation. This is precisely the object of the present invention.

2. Description of the Prior Art

In FIG. 1, the scatterers $D_{N-1}$, $D_N$, $D_{N+1}$, with gates $B_{N-1}$, $B_N$, $B_{N+1}$, and compressors $C_{N-1}$, $C_N$, and $C_{N+1}$ have been symbolized. The arrows represent the various recyclings of the scattered and unscattered flows.

Through French Pat. No. 1,237,157, for example, a compressor is known which allows this recycling of the secondary gaseous flow. According to this patent, the compressor includes a primary compression unit which acts on the principal flow and an auxiliary compression wheel which compresses the flow to be recycled so that the outlet flow unit has the same pressure in a so-called mixing stage. However, the conception of this stage is aerodynamically complex, and its realization is costly.

SUMMARY OF THE INVENTION

The object of the present invention is therefore to provide a compressor not having the above-noted auxiliary wheel but which nonetheless makes it possible to assure the compression of the secondary gaseous flow and the mixing of the principal flow and the secondary flow to obtain an outlet flow at a suitable pressure.

Another object of the invention is to realize such a compressor allowing such recycling in such a way that its manufacture costs less.

A further object of the present invention is to realize a compressor allowing the recycling by means of devices integrated into the compressor, these devices being static.

An additional object of the invention is to realize such a compressor in which the pressure ratio required for the secondary or recycled flow is low, that is, slightly greater than 1. This ratio is for example between 1.01 and 1.05.

To achieve this result, the invention includes a compressor to deliver in its scatterer an outlet flow at a given pressure from a principal flow at a first pressure and a secondary flow at a second pressure, the second pressure being greater than the first pressure, said outlet pressure being greater than the first and second pressures, which is characterized by the fact that the compressor has an inlet for the principal flow, mobile compression devices to raise the pressure of the principal flow to a value greater than the outlet pressure, and a plurality of devices housed in the scatterer to introduce the secondary flow into the static devices forming an induction nozzle, the principal flow constituting the drive flow of the secondary flow at its outlet from the compression devices.

It is therefore understood that according to the present invention, instead of utilizing a supplementary wheel in the compressor to treat the secondary flow, static devices are utilized forming an induction nozzle to mix and carry the flow mixture to the appropriate pressure, in order to obtain an outlet flow at the desired pressure. In other words, in the compressors's scatterer static devices are utilized forming a pump in order to achieve with the aid of an induction nozzle a mixture of the two gaseous flows so that they will exit at a suitable pressure.

For greater clarification of the phenomenon of induction drive or pump drive, reference can advantageously be made to French Pat. No. 2,010,938 filed on Feb. 20, 1970, for an "Injector Pump".

According to the present invention, the integration of this injector or induction system is done in such a way as to obtain the best possible overall output for the compressor, whatever the type of original compressor. The invention thus concerns axial compressors with a toric scatterer, centrifugal compressors, and axial compressors with straight scatterer. In all cases, integrated into the compressor's scatterer is a system forming an injection pump or induction nozzle, in which the principal flow constitutes the drive flow of the secondary flow, the total pressure to which the principal flow is carried being slightly greater than the final pressure for the mixture which it is wished to obtain, but the static pressure at the junction of the two flows is common. Calculations and experiments done show that optimization of the system is thus obtained if the ratio of the pressures of the recycled secondary flow is on the order of 1.05.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE PREFERRED EMBODIMENTS

Figure 2:
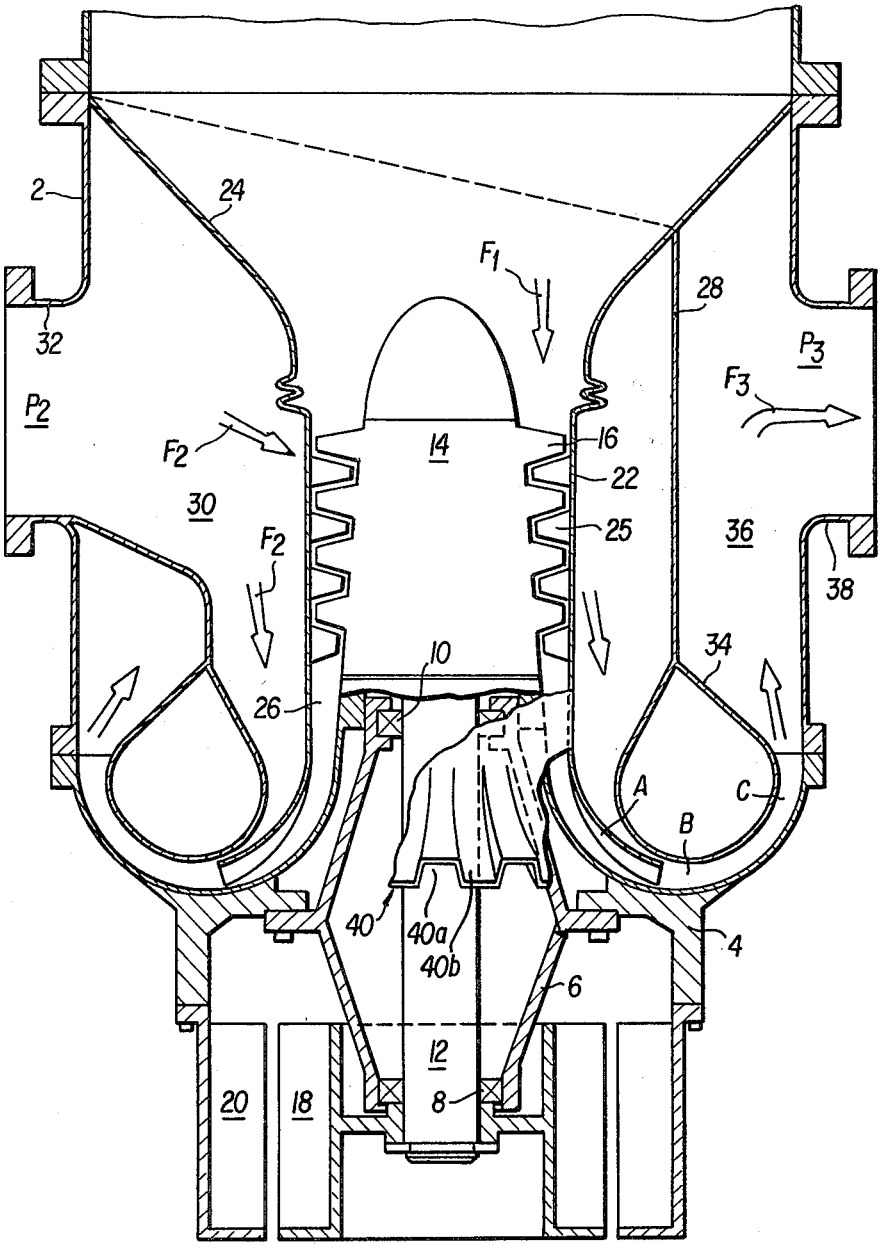
FIG. 2 is a longitudinal or axial sectional view of a compressor having the pump device for mixing the principal flow and the secondary flow, this compressor being of the toric scatterer type.

In FIG. 2, a first mode of the present invention has been shown in the case where an axial compressor is used with a toric scatterer. In this FIGURE, the housing of the compressor is found in the classical manner to consist of a cylindrical collar 2 closed at its lower end by a bottom part 4. Onto this bottom part 4 is affixed a biconical case 6 at the ends of which are mounted bearings 8 and 10. In bearings 8 and 10 is mounted a shaft 12 of the compressor at the end of which is the rotor 14 with its blade rings 16. Also shown schematically in this FIGURE is a rotor 18 of the drive engine attached to the shaft 12 and the stator of this engine which is attached to the bottom part 4.

Inside the housing, and more precisely inside the cylindrical collar 2 is the stator of the compressor which includes a cylindrical plate 22 inside of which have been mounted blades 25 which cooperate with the mobile blade rings 16 of the rotor. This mobile unit thus constitutes the fluid compression device. The plate 22 of the stator extends along a converging wall 24 attached by its upper periphery to the collar 2 of the compressor housing. Converging wall 24 constitutes the inlet of the principal gaseous flow to be compressed, and at the outlet 26 of the space limited by the stator 22 of the principal flow is compressed.

Between the stator 22 and the cylindrical collar 2 are several separator plates. On the one hand, there is the essentially cylindrical plate 28 which has an inlet space 30 attached to the pipe 32 by which the secondary fluid enters, that is, the gaseous flow to be recycled. On the other hand there is a second separator plate 34 which, with the bottom part 4, defines the toric scatterer of the compressor. It can thus be seen that the lower part of the space 30 can communicate with the lower zone 26 defined by the stator 22. Between the cylindrical plate 28 and the cylindrical collar 2 is provided a space 36 attached to the scattering zone, space 36 being furnished with an outlet pipe 38 of the outlet gaseous flow which consists of the mixture of principal flow entering by the converging wall 24 after compression and the flow to be recycled entering by the pipe 32.

As has already been explained, according to the invention the mixing and compression of the secondary flow is achieved by induction nozzles or pumps. In order to optimize the output of the installation, these nozzles are arranged at the inlet of the compressor's scatterer. More precisely, as can be seen in FIG. 2, these nozzles consist of a plate 40 which extends the stator 22 of the compressor. Plate 40 is corrugated and includes a succession of hollows **40*a* and steps 40*b*. It can also be seen that plate 40 is positioned between the bottom part 4 and the separator plate 34. It can thus be understood that in this way hollows 40*a* are in communication with the outlet zone 26 of the compressor proper, and the steps 40*b* with the inlet space 30 of the secondary flow to be recycled. In addition, lengthwise this succession of hollows and steps forms the equivalent of a nozzle. As seen in FIG. 2, there is thus a zone of interpenetration. A corresponding to the zone of plate 40**, the mixing zone B, and finally scattering zone C proper.

The operation of the compressor with recycling according to the invention follows obviously from the preceding description. The principal flows $F_1$ enters by converging wall 24 and is compressed to a pressure $P_1$ slightly greater than the desired outlet pressure $P_3$. The secondary flow $F_2$ at pressure $P_2$ is admitted by pipe 32 and penetrates space 30. In the interstices defined by plate 40 and in mixing zone B, there is an induction effect which assures compression of the secondary flow. This flow is mixed in zone B and arrives in scattering zone C, from where it penetrates space 36. At the outlet through the pipe, a mixed flow $F_3$ is obtained at the desired outlet pressure $P_3$.

As has already been indicated, the compression rate assured by the rotor is slightly greater than the pressure which it is desired to obtain at outlet pressure $P_3$. This surplus energy serves as motor fluid in the pump or injection nozzle. This device is particularly worthwhile when the compression ratio required for the recycled secondary fluid is low, around 1.05.

Figure 3:
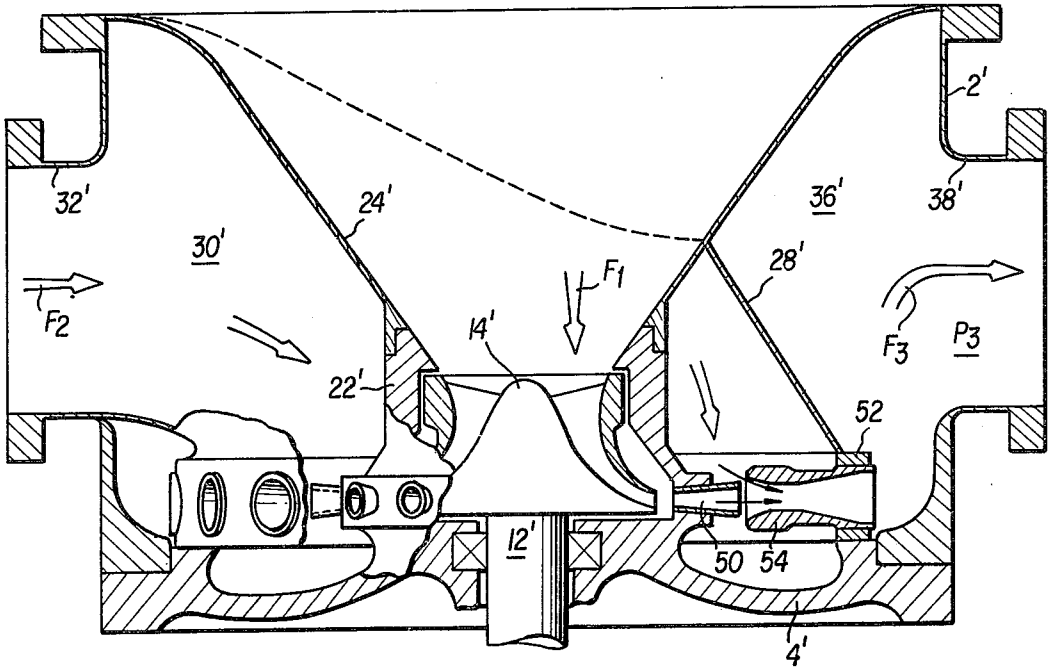
FIG. 3 is a longitudinal or axial sectional view of a compressor of the centrifugal type including the improvement according to a second embodiment of the present invention.

In FIG. 3, a second embodiment of the invention has been shown utilizing a centrifugal compressor.

Once again there is a cylindrical collar 2' of the compressor housing and its bottom part 4'. There is also drive shaft 12' of rotor 14'. The rotor is placed inside stator 22' the lower part of which is attached to bottom part 4' and the upper part of which is attached to converging wall 24' which constitutes the inlet of the principal gaseous flow $F_1$. According to this embodiment, scatterers 50 constituting the outlet of the compressor proper are mounted in a ring on the stator 22'. A separator plate 28' separates introduction space 30 of the flow to be recycled $F_2$ from outlet space 36' of the mixed flow. Plate 28' is attached to the outside face of the convergent line 24' and to an annular part 52 attached to bottom part 4'. In annular part 52 are mounted induction nozzles 54, the axes of pumps 54 and of scatterers 50 being common. It can be understood that scatterers 50 communicate with space 30', while the inlet of pumps 54 is also found in space 30' and their outlets communicate with space 36'.

According to this embodiment, the principal flow $F_1$, after being compressed by the rotor 14', exits by scatterers 50. The flow to be recycled $F_2$ penetrates space 30' and continues to a position at the inlet of injection pumps 54. The compressed principal flow existing from scatterers 50 serves as motor fluid for the flow to be recycled. At the outlet of pumps 54, i.e., in space 36', is found mixed flow $F_3$ at the desired outlet pressure $P_3$.

Figure 1:
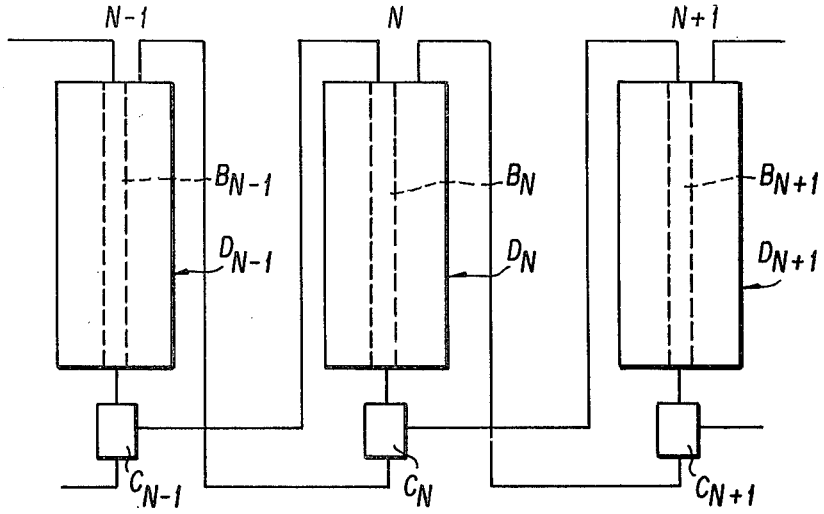
FIG. 1 PRIOR ART
FIG. 1 is a schematic view illustrating an installation for isotopic enrichment by gaseous scattering.
Figure 4:
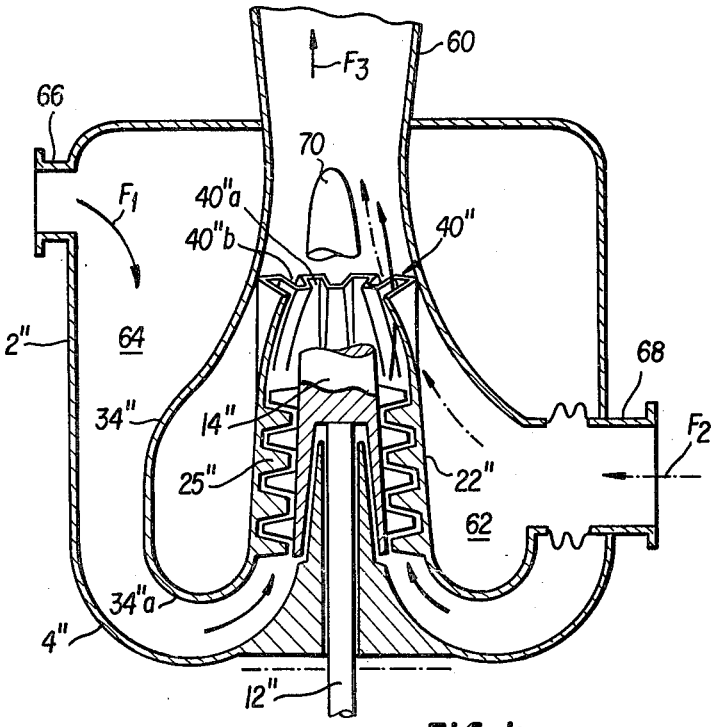
FIG. 4 is a longitudinal or axial sectional view of a compressor of the axial scatterer type also having a pump device or injection nozzle device according to a third embodiment of the present invention.

In FIG. 4 a third embodiment of the compressor has been shown. This is of the axial type with straight scatterers.

Once again an external cylindrical housing 2'' is provided which is closed at its lower part by bottom part 4''. Bottom part 4'' is traversed by shaft 12'' of rotor 14'' of the compressor, rotor 14'' of course being furnished with a blading ring. Rotor 14'' is surrounded by its stator, consisting of collar 22'' and fixed blades 25''. A revolving separator plate 34'' is attached by a toric bottom **34''*a* to the lower part of coller 22'' of the compressor's stator. The upper end of separator plate 34'' is attached to the lower of an outlet divergent line 60** by which the mixed flow $F_3$ exists.

Separator plate 34'' defines with collar 22'' an internal space 62 and with external housing 2'' an external space 64. A pipe 66 communicating with the housing 2'' allows introduction of principal flow $F_1$. A section of piping 68 traverses housing 2'' and is attached to separator plate 34''. Thus piping 68 tightly traverses the external space 64 and communicates with internal space 62. Piping 68 therefore allows introduction of the flow to be recycled $F_2$ into space 62. Collar 22'' of the stator of the compressor is extended by a corrugated plate 40'' analogous to corrugated plate 40 represented in FIG. 2. Plate 40'' thus defines two series of alternating passages **40''*a* and 40''*b* regularly distributed around the axis of the compressor. Definition of these passages is complemented by the lower part of the diverging wall 60 and by extension 70 of rotor 14''. These two types of passages communicate at their upper end with diverging wall 60. At their lower end, passages 40''*a* communicates with the internal compression zone at collar 22'' and passages 40''*b* into internal space 62**. Thus a multiplicity of induction nozzles is achieved according to the invention.

In the examples described above, a multiplicity of passages **40*a*, 40''*a*, 40*b*, 40''*b* or nozzles 50 and 54 has been represented. Naturally, and in particular in the case of FIGS. 2 and 4**, it would in principle be possible to have only a single passage of each type, each passage occupying a half circumference. It is however understood that by multiplying the number of passages the distribution of the compressed principal flow and the flow to be recycled is improved.

If it is assumed that the flow to be recycled is equal to the principal flow and that the compression rate to be applied to the recycled flow is 1.05, it will be found that the overall output of the motocompressor according to the invention is lower than that of a compressor with a helico-centrifugal recycling wheel by only 1 to 2%, which is very low considering the advantage represented by this embodiment.

It must be added that in order to obtain this result it is necessary to multiply by about 1.22 the principal compression rate in order to assure the induction effect. In addition, under the same hypotheses but with a secondary flow compression rate between 1.03 and 1.04, the overall output is equal to that obtained with the previous solution. Generaly, speaking, the value of the invention increases in effect as the compression rate of the recycled flow drops. Likewise, this value rises as the flow to be recycled declines in relation to the rate of the principal flow.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A compressor having a scatterer to deliver in said scatterer an outlet flow at a given pressure from a principal flow at a first pressure and a secondary flow at a second pressure, said second pressure being greater than said first pressure, said outlet pressure being greater than said first and second pressures, said compressor comprising:

a principal flow inlet;

a plurality of mobile compression devices for raising the pressure of the principal flow to a value greater than said outlet pressure and to deliver flow to said scatterer of the compressor;

a plurality of static devices forming an induction nozzle housed in said scatter;

a plurality of devices for introducing said secondary flow in said devices forming said induction nozzle, said principal flow upon exiting from the mobile compression devices constituting the drive flow of the secondary flow; and a rotor having an outlet so as to form the mobile compression device and a corrugated plate positioned at an inlet portion of the scatterer defining at least one first passage fed by the principal flow upon exiting from the rotor and at least one second passage fed by the secondary flow.

2. A compressor according to claim 1, further comprising a plurality of separator plates defining both the other wall of the scatterer and an annular space fed by said secondary flow, said compressor further comprising an axial type compressor having a stator with a collar and said scatterer further comprising a toric scatterer, said currugated plate defining a multiplicity of said first and second passages, said corrugated plate forming an extension of the collar of the stator of said compressor and said corrugated plate being housed between a bottom part constituting a wall of the scatterer and the separator plates.

3. A compressor according to claim 1, said rotor including a part extending therefrom, further comprising a separator plate defining an annular space communicating with said secondary flow, said compressor further comprising an axial type compressor housing a stator with a collar and said scatter comprising a straight scatterer, said corrugated plate defining a plurality of said first and second passages, said corrugated plate extending the collar of the stator of said compressor and said corrugated plate being housed between a wall of the scatterer attached to the separator plate and said part extending from said rotor.

4. A compressor according to claims 1, 2 or 3 wherein the compressor ratio of the secondary flow is approximately 1.05.

* * * * *

UNITED STATES PATENT AND TRADEMARK OFFICE

CERTIFICATE OF CORRECTION

PATENT NO. : 4,431,377

DATED : February 14, 1984

INVENTOR(S) : Joseph Plotkowiak et al.

It is certified that error appears in the above-identified patent and that said Letters Patent is hereby corrected as shown below:

In column 4, line 24, delete ".";

In column 4, line 28, change "flows" to --flow--;

In column 5, line 17, change "coller" to --collar--;

In column 5, line 66, change "Generaly, speaking," to --Generally speaking,--;

In column 6, line 26, change "scatter" to --scatterer--;

In column 6, line 45, change "currugated" to --corrugated--;

In column 6, line 56, change "scatter" to --scatterer--;

In column 6, line 64, change "compressor" to --compression--.

Signed and Sealed this

*Twelfth* Day of *March 1985*

[SEAL]

*Attest:*

DONALD J. QUIGG

*Attesting Officer* *Acting Commissioner of Patents and Trademarks*